US012378772B2

(12) United States Patent
Li et al.

(10) Patent No.: US 12,378,772 B2
(45) Date of Patent: Aug. 5, 2025

(54) ADJUSTABLE AWNING

(71) Applicant: A&C FUTURE, INC., Newport Beach, CA (US)

(72) Inventors: Sichen Li, Santa Ana, CA (US); Jiuqi Wang, Santa Ana, CA (US); Zhuangboyu Zhou, Santa Ana, CA (US); Xunmin Jiang, Irvine, CA (US); Ju Gao, Newport Beach, CA (US); Shoue Chen, Irvine, CA (US); Han Qin, Newport Beach, CA (US); Jiayang Qin, Newport Beach, CA (US)

(73) Assignee: A&CFUTURE, INC., Newport Beach, CA (US)

( * ) Notice: Subject to any disclaimer, the term of this patent is extended or adjusted under 35 U.S.C. 154(b) by 408 days.

(21) Appl. No.: 18/058,480

(22) Filed: Nov. 23, 2022

(65) Prior Publication Data

US 2024/0167287 A1 May 23, 2024

(51) Int. Cl.
*E04F 10/06* (2006.01)
*E04F 10/10* (2006.01)

(52) U.S. Cl.
CPC ..... *E04F 10/0618* (2013.01); *E04F 10/0692* (2013.01); *E04F 10/10* (2013.01)

(58) Field of Classification Search
CPC ... E04F 10/10; E04F 10/0618; E04F 10/0692; E04F 10/0696; E04F 10/0648;
(Continued)

(56) References Cited

U.S. PATENT DOCUMENTS 1,749,197 A * 3/1930 Stuart ..... E04F 10/0651 160/68
1,890,406 A * 12/1932 Pollard ..... E04F 10/0685 160/68

(Continued)

FOREIGN PATENT DOCUMENTS

EP 0810336 B1 * 2/2002 ..... E04F 10/0618
EP 2845962 A1 * 3/2015 ..... E04F 10/0603

OTHER PUBLICATIONS

EP 2845962 Machine translation, Dong, 2015, retrieved from https://worldwide.espacenet.com/publicationDetails/biblio?CC=EP&NR=2845962A1&KC=A1&FT=D&ND=3&date=20150311&DB=&locale=en_EP (Year: 2015).*

*Primary Examiner* — Abe Massad
(74) *Attorney, Agent, or Firm* — INNOVATION CAPITAL LAW GROUP, LLP; Vic Lin

(57) ABSTRACT

An adjustable awning has no longitudinal linkage, which makes efficient use of space, can be assembled with a collapsible roof as a whole, increasing the function of the collapsible roof, and can be unfolded together with the collapsible roof, controlled by a mechanism inside the collapsible roof, and the control mechanism can be adjusted to select whether the awning is linked to the roof or not. The horizontal adjustable awning includes an internal control mechanism, a main transmission mechanism and a folding mechanism. The internal control mechanism includes a spring roller, a drive belt, a belt end block and a block snap; the main transmission mechanism includes a pulley, a filament rod, a shade cloth mechanism, a bearing housing, a rack and pinion mechanism and a gear housing; the folding mechanism includes two rotating pushers, two articulated sliders and a protective plate.

18 Claims, 12 Drawing Sheets

(58) Field of Classification Search
CPC ..... E04F 10/0651; E04F 10/0625; E04F 10/0688; E06B 2009/2464
See application file for complete search history.

(56) References Cited

U.S. PATENT DOCUMENTS

| | | | | |
|---|---|---|---|---|
| 3,074,474 | A * | 1/1963 | Dunn | E04F 10/0651 160/310 |
| 4,214,621 | A | 7/1980 | Wessels et al. | |
| 4,733,683 | A | 3/1988 | Pozzi | |
| 5,192,111 | A | 3/1993 | Hanemaayer | |
| 6,135,192 | A * | 10/2000 | Suzuki | B60J 1/2055 160/265 |
| 6,341,638 | B1 | 1/2002 | Thompson et al. | |
| 6,363,664 | B1 * | 4/2002 | Brutsaert | E04F 10/0618 52/63 |
| 6,782,904 | B2 * | 8/2004 | Tien | E04F 10/0618 135/88.11 |
| 6,782,936 | B1 | 8/2004 | Girard et al. | |
| 7,513,289 | B2 * | 4/2009 | Weddell | E04F 10/0611 160/55 |
| 8,347,935 | B2 * | 1/2013 | Svirsky | E04F 10/10 160/82 |
| 9,908,395 | B2 * | 3/2018 | Lichowski | B60J 11/02 |
| 10,724,257 | B2 * | 7/2020 | Moran | E04G 5/142 |
| 11,285,793 | B2 * | 3/2022 | Jiang | B60J 11/04 |
| 2009/0013614 | A1 | 1/2009 | Rogers | |
| 2014/0182791 | A1 * | 7/2014 | Lee | G09F 23/02 160/34 |
| 2018/0320381 | A1 * | 11/2018 | Ma | E04F 10/0625 |
| 2022/0127855 | A1 | 4/2022 | Chen | |
| 2024/0417989 | A1 * | 12/2024 | Snapir | E01F 13/046 |

* cited by examiner

ADJUSTABLE AWNING

BACKGROUND OF THE INVENTION

1. Field of the Invention

Embodiments of the invention relate generally to awnings. More particularly, embodiments of the invention relate to adjustable awning that can attach and extend from a structure, such as a folding roof.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Awnings are often used to extend a fabric over an area to protect people from weather, sun and the like. Typical awnings have a roller that extends the fabric and arms that support the fabric in an upright, often nearly horizontal position. Conventional awnings often use vertical or diagonal braces which may make use with retractable roofs difficult. Further, typical retractable roofing may not have sufficient space for mounting an awning, especially when the roof is retracted and stowed.

In view of the foregoing, there is a need for an awning structure that can be installed with a retractable/folding roof structure.

SUMMARY OF THE INVENTION

Embodiments of the present invention aim to solve the aforementioned problems in conventional awnings.

Embodiments of the present invention provide an awning system comprising a housing fixed to a structure; an awning spool supported by the housing and having awning fabric extendable therefrom and retractable thereinto; a first arm supported by the housing and disposable alongside the structure supporting the awning spool; a second arm supported by the housing and disposable adjacent the first arm and alongside the structure; first and second gearing structures each supported by the housing and configured to pivot, respectively, the first arm and the second arm, at a first end of each thereof, simultaneously away from the structure; and a protection plate pivotably connected to a second end of each of the first and second arms, the protection plate attached to a distal end of the awning fabric to move the awning fabric off the awning spool and above the first and second arms, as the first and second arms move the protection plate away from the structure.

Embodiments of the present invention provide an awning system comprising a housing fixed to a structure; an awning spool supported by the housing and having awning fabric extendable therefrom and retractable thereinto; a first arm supported by the housing and disposable alongside the structure supporting the awning spool when the awning fabric is retracted; a second arm supported by the housing and disposable adjacent the first arm and alongside the structure when the awning fabric is retracted; first and second pulleys, each pully rotatably attached to the housing; first and second rollers each having a belt wrapped therearound and the belt extending around respective first and second pulleys and further extending back toward the respective first and second rollers, the first and second rollers being in a fixed location during retraction and extension of the retractable roof; first and second screw rods each turning with rotation of respective first and second pulleys; first and second racks movable along respective first and second screw rods during turning of respective first and second screw rods; and first and second pinions movable with respective first and second racks with rotation of respective first and second pulleys, wherein the first end of the first arm is connected to the first pinion and the first end of the second arm is connected to the second pinion; and a protection plate pivotably connected to a second end of each of the first and second arms, the protection plate attached to a distal end of the awning fabric to move the awning fabric off the awning spool and above the first and second arms, as the first and second arms pivot to move the protection plate away from the structure.

Embodiments of the present invention provide an awning system comprising a retractable roof; a housing fixed to an outside end of the retractable roof, the outside end moving during retraction and extension of the retractable roof; an awning spool supported by the housing and having awning fabric extendable therefrom and retractable thereinto; a first arm supported by the housing and disposable alongside the structure supporting the awning spool; a second arm supported by the housing and disposable adjacent the first arm and alongside the structure; first and second gearing structures each supported by the housing and configured to pivot, respectively, the first arm and the second arm, at a first end of each thereof, simultaneously away from the structure; a protection plate pivotably connected to a second end of each of the first and second arms, the protection plate attached to a distal end of the awning fabric to move the awning fabric off the awning spool and above the first and second arms, as the first and second arms move the protection plate away from the structure; first and second rollers attached to an inside end of the retractable roof, the inside end fixed during retraction and extension of the retractable roof; and first and second belts wrapped around and extending from respective first and second gearing structures, wherein movement of the retractable roof causes the first and second belts to move and engage with the first and second gearing structures.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
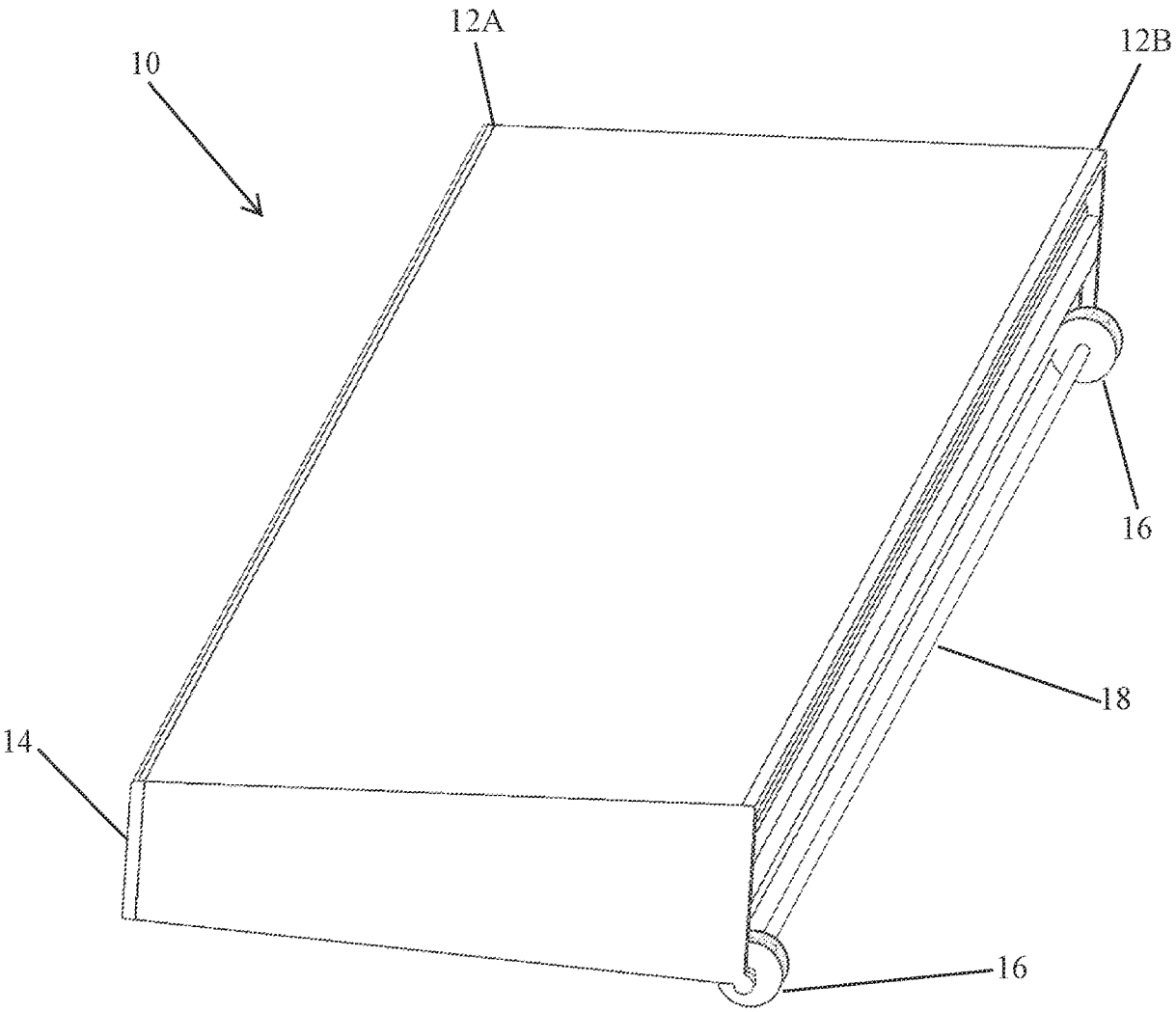
FIG. 1 illustrates a perspective view of an awning and retractable roof assembly in a fully retracted configuration, according to an exemplary embodiment of the present invention.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an adjustable awning that has no longitudinal linkage, which makes efficient use of space, that can be assembled with a collapsible roof as a whole, increasing the function of the collapsible roof, and that can be unfolded together with the collapsible roof, controlled by a mechanism inside the collapsible roof, and the control mechanism can be adjusted to select whether the awning is linked to the roof or not. The horizontal adjustable awning includes an internal control mechanism, a main transmission mechanism and a folding mechanism. The internal control mechanism includes a spring roller, a drive belt, a belt end block and a block snap; the main transmission mechanism includes a pulley, a filament rod, a shade cloth mechanism, a bearing housing, a rack and pinion mechanism and a gear housing; the folding mechanism includes two rotating pushers, two articulated sliders and a protective plate.

Figure 12:
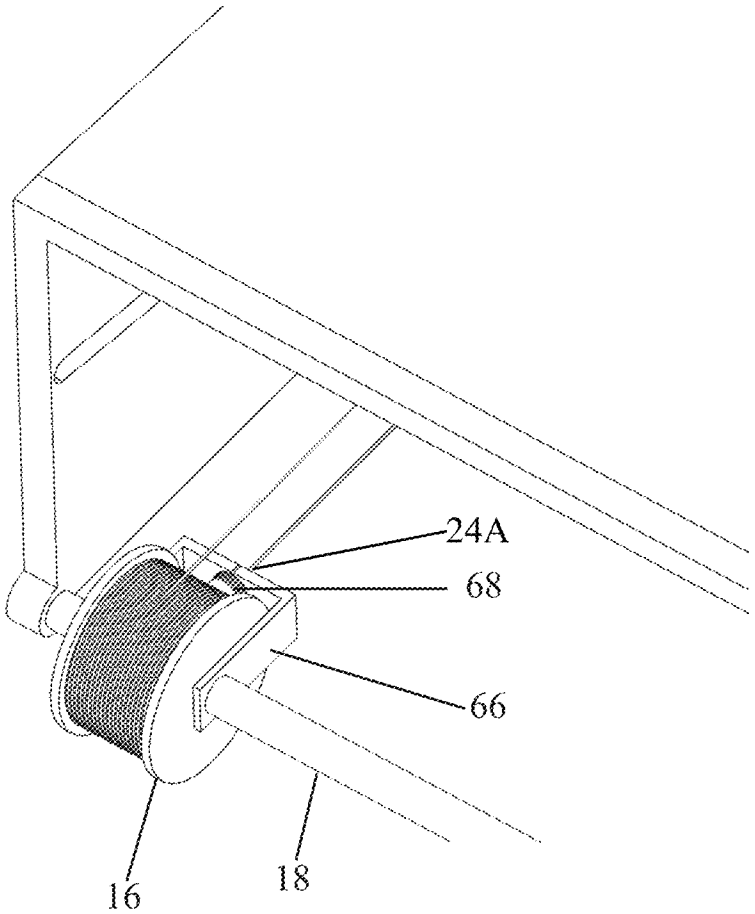
FIG. 12 illustrates a detailed perspective view of the roller mechanism, including an engagement/disengagement arm, of the awning and retractable roof of FIG. 1.

Aspects of the present invention provide an adjustable awning, which is characterized by the fact that it can be installed on a collapsible roof and unfolded together with the roof. As shown in the figures, described below, the awning structure is basically functionally symmetrical along both sides thereof, and the structural difference between the two sides is mainly that the push rod of the external unfolding mechanism is at different heights, so the gears on both sides fixed with the push rod are also at different heights. The internal control mechanism is symmetrical along both sides of the awning structure and includes a pulley with a coiled spring, a block at the end of the drive belt and a block catch, as shown in FIG. 12. When the block is mounted on the block catch, the awning can unfold together with the collapsible roof; when the block is not mounted on the block catch, the awning cannot unfold together with the roof. When the block is mounted on the block snap, during the unfolding of the folding roof, the drive belt will be stretched as the main drive mechanism is mounted at the end of the roof, and the pulley inside the active drive mechanism will be carried by the drive belt to rotate (as in FIG. 8), and as the screw rod is fixedly connected to the pulley, the screw rod will rotate, so the slider will move along the axial direction of the screw rod, so the rack on the slider will rotate the gear. Since the gear is fixed to the push rod, the push rod rotates, which in turn pushes the protection plate and pulls the shade cloth out of its retracting mechanism. Since the mechanism is essentially symmetrical on both sides, the pushrods on both sides maintain the same speed of rotation in reverse and the protection plate remains parallel to the side of the roof. The protection plate seals the roof when the roof and awning are fully retracted, ensuring that the roof remains clean in the folded state.

The figures are briefly described below, followed by a broader discussion of each figure and the components therein.

Figure 2:
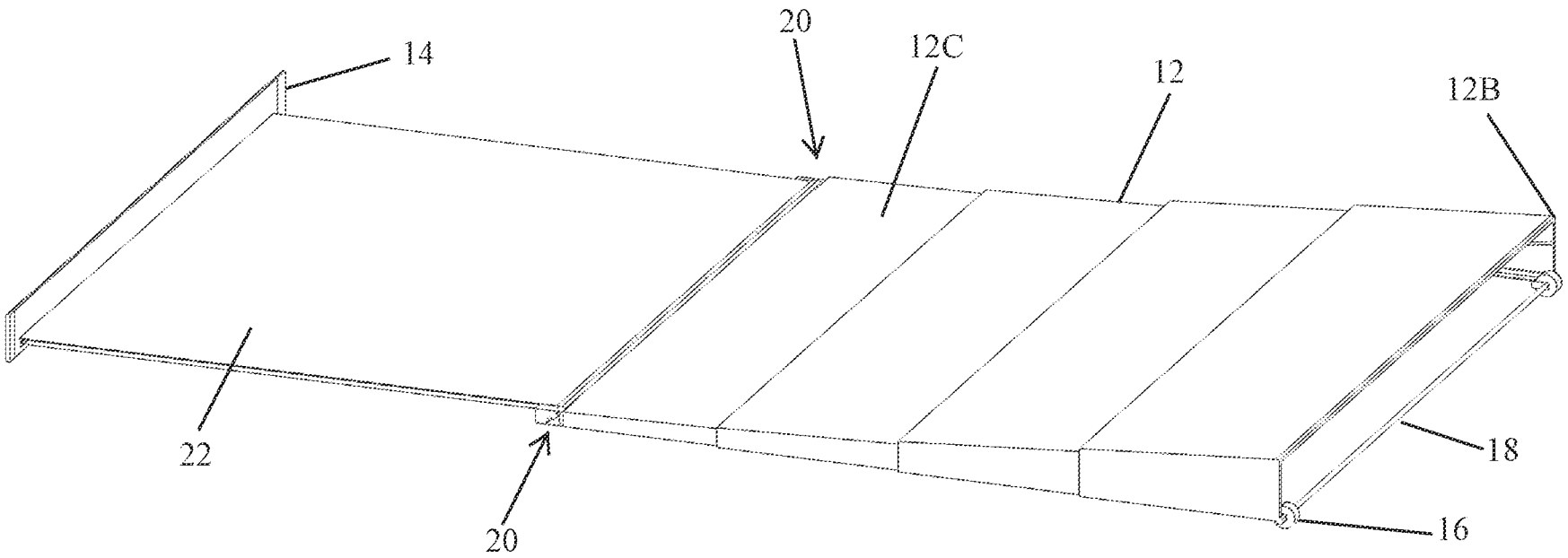
FIG. 2 illustrates a perspective view of the awning and retractable roof of FIG. 1 in a fully extended configuration.
Figure 3A:
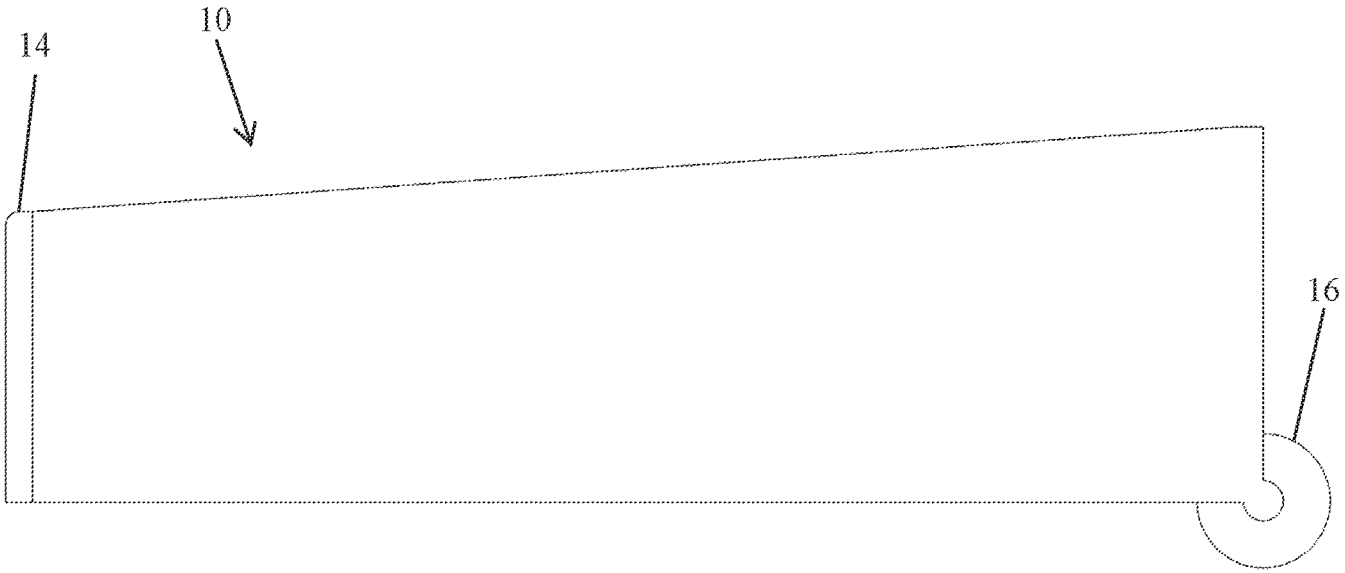
FIG. 3A illustrates a side view of the fully retracted awning and retractable roof of FIG. 1.
Figure 3B:
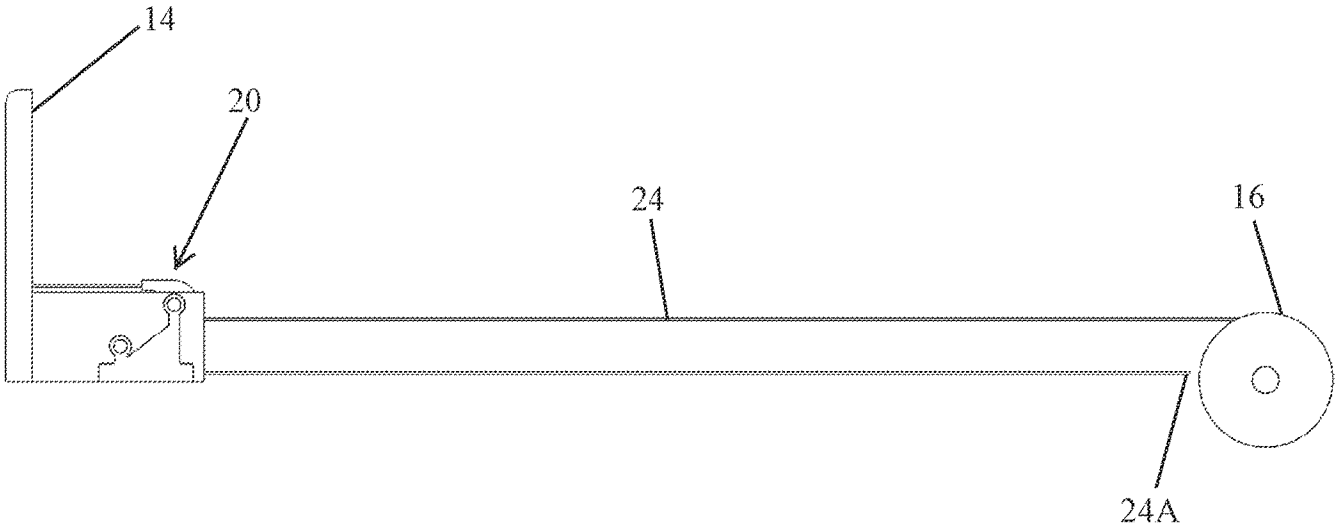
FIG. 3B illustrates a side view of the awning assembly, in a retracted configuration, from the awning and retractable roof of FIG. 1.

FIG. 1 shows the awning is mounted on the foldable roof (also referred to as a retractable roof, or a collapsible roof), and they are all folded. FIG. 2 shows the unfolded state of the awning structure on the roof. The awning structure can be divided into three parts, including an internal control mechanism, a main drive mechanism and a folding mechanism. FIGS. 3A and 3B show a side view of the awning structure. In FIG. 3A, the awning structure is mounted on the roof, in FIG. 3B, all mechanisms of the awning structure are isolated from the roof system.

Figure 4A:
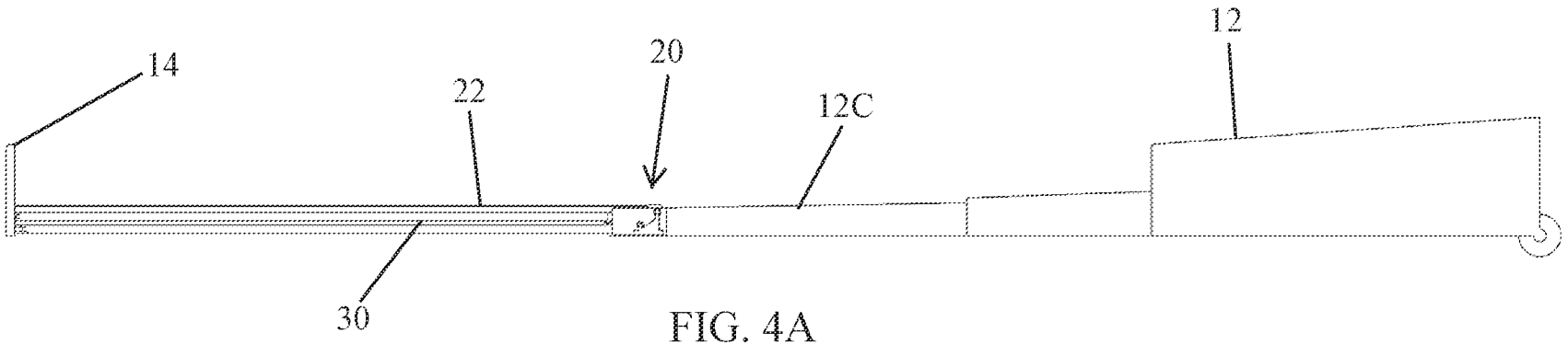
FIG. 4A illustrates a side view of the fully extended awning and retractable roof of FIG. 2.
Figure 4B:
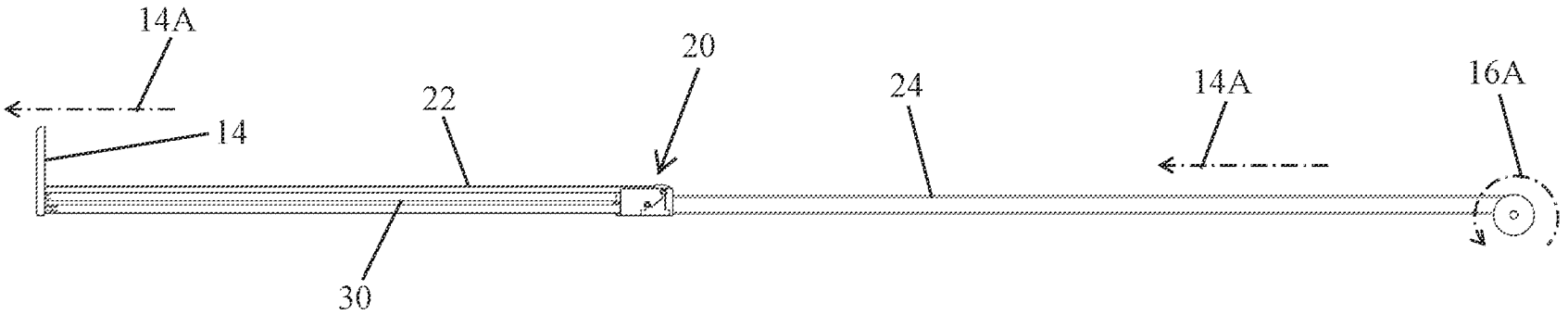
FIG. 4B illustrates a side view of the awning assembly, in a fully extended configuration, from the awning and retractable roof of FIG. 2.
Figure 5:
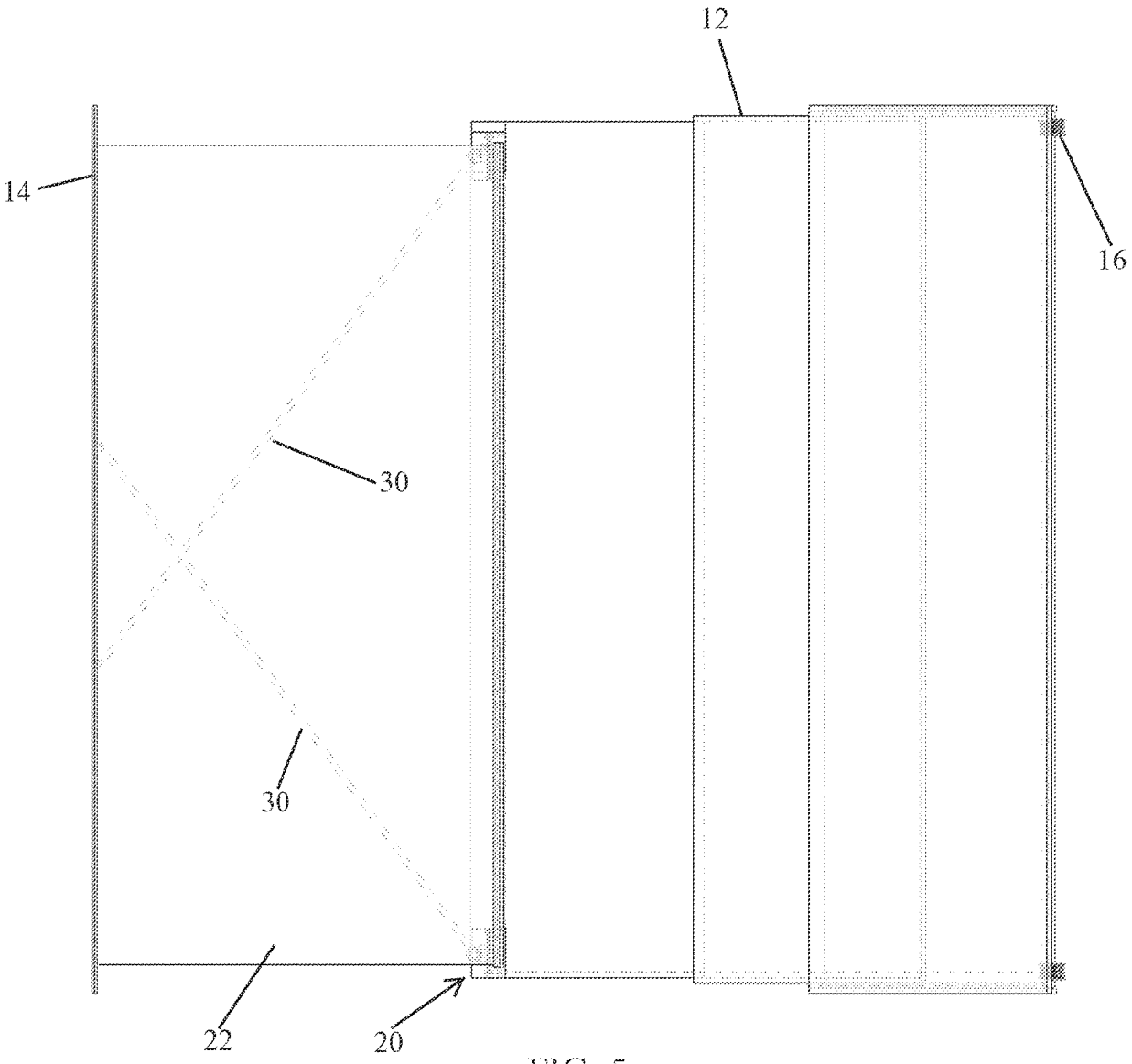
FIG. 5 illustrates a top view of the fully extended awning and retractable roof of FIG. 2.

FIGS. 4A and 4B show the state of the awning structure during unfolding. The drive belt is wrapped around the spring rollers. Since the awning structure can be installed on the last roof module of the roof, when the roof is unfolded, the drive belt can be extended from the rollers and the spring rollers will turn counterclockwise. The drive belt can act on the main drive mechanism, thus driving the folding mechanism to unfold. FIG. 5 shows the top view of the invention during unfolding.

Figure 6:
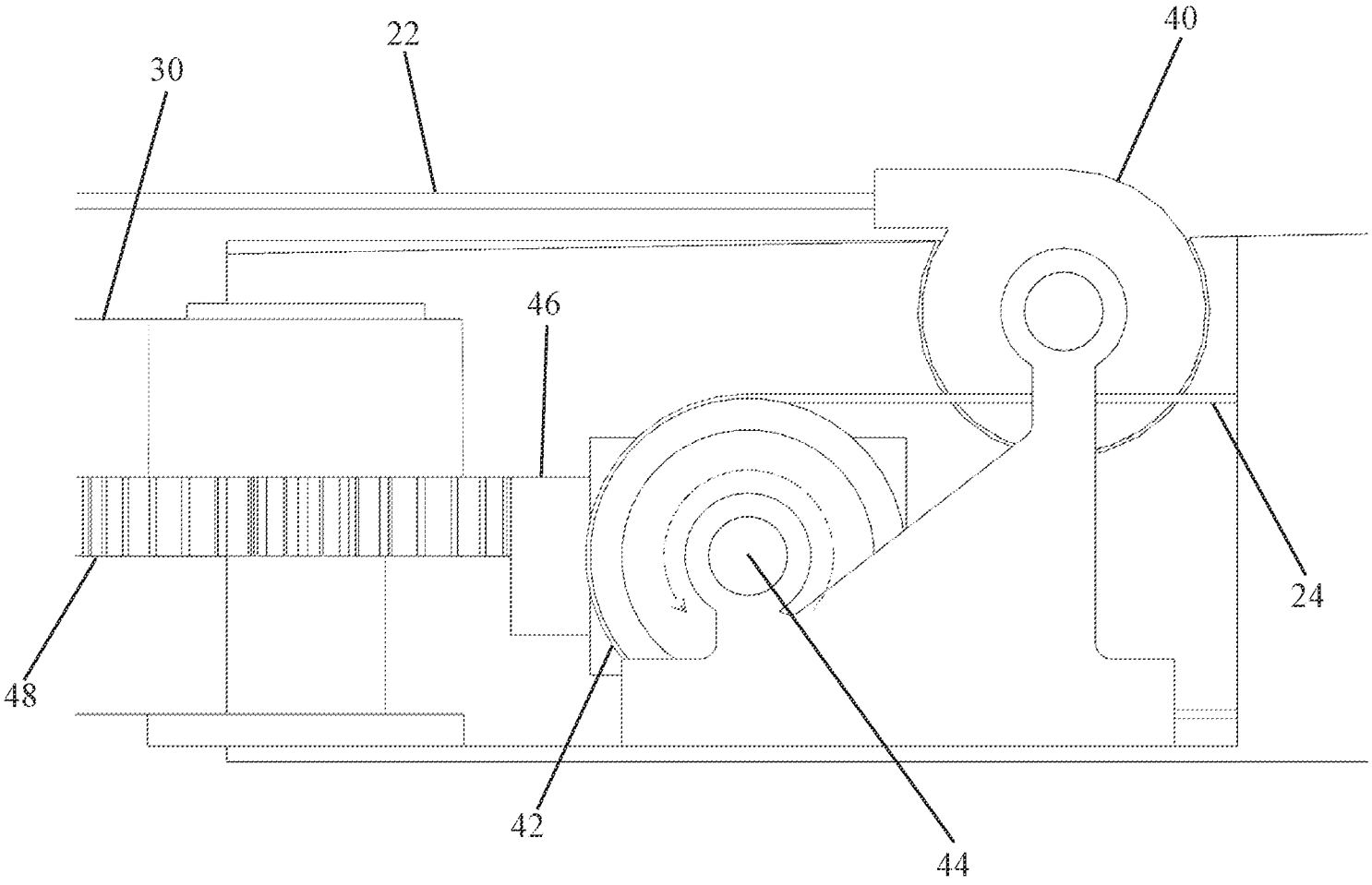
FIG. 6 illustrates a detailed side view of an awning arm movement assembly usable in the awning and retractable roof of FIG. 1.

FIG. 6 shows the side view of the main drive mechanism. The roller is driven by the drive belt and is mounted on the bearing housing together with the shade cloth mechanism. When the roof is unfolded, the pulley rotates along the directional arrow in the figure. The gear is mounted with the push rod and do not move or rotate relative to each other. They are mounted on the gear housing and rotate relative to the shaft of the gear housing.

Figure 7:
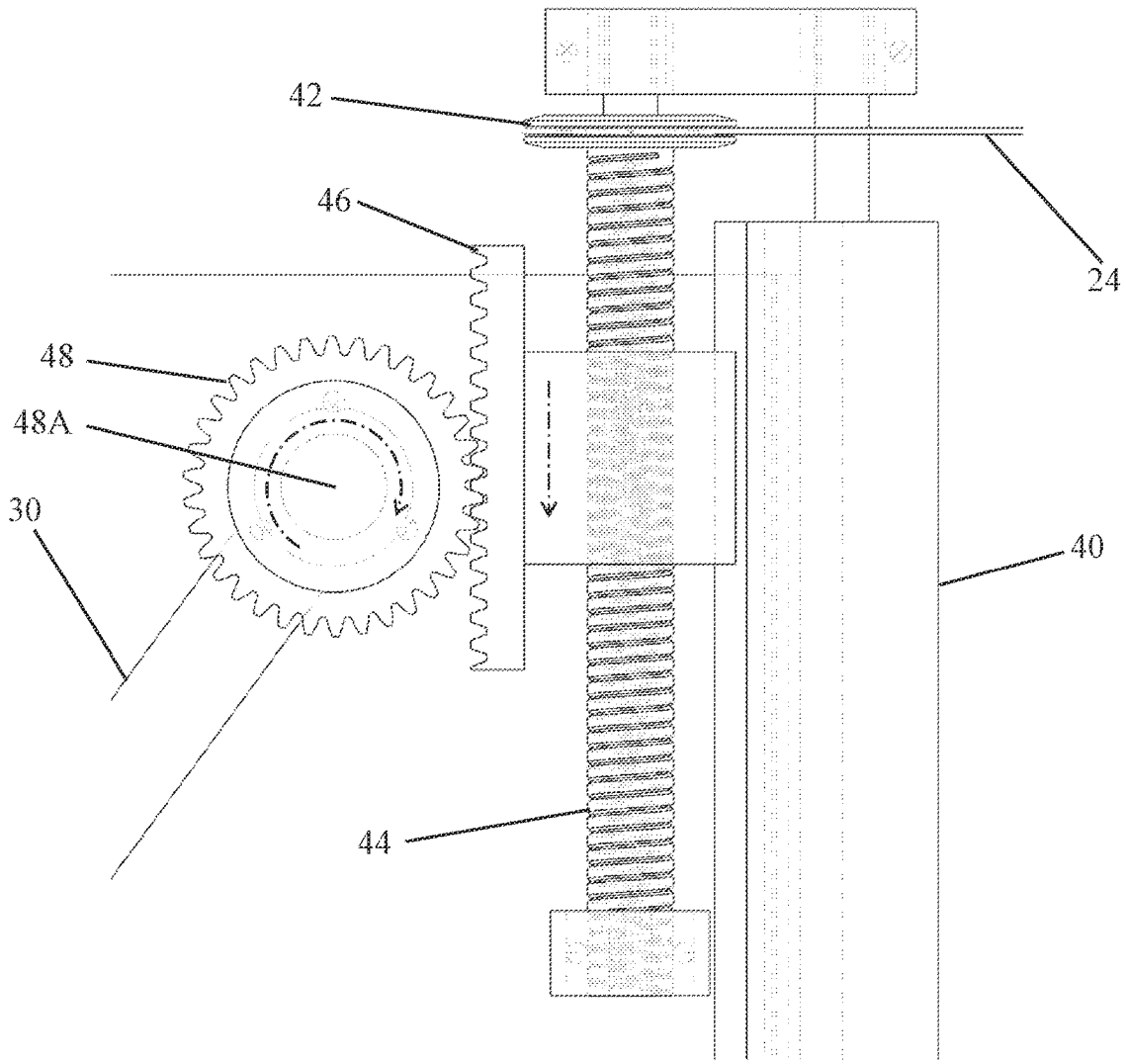
FIG. 7 illustrates a detailed top view of an awning arm movement assembly usable in the awning and retractable roof of FIG. 1.
Figure 8:
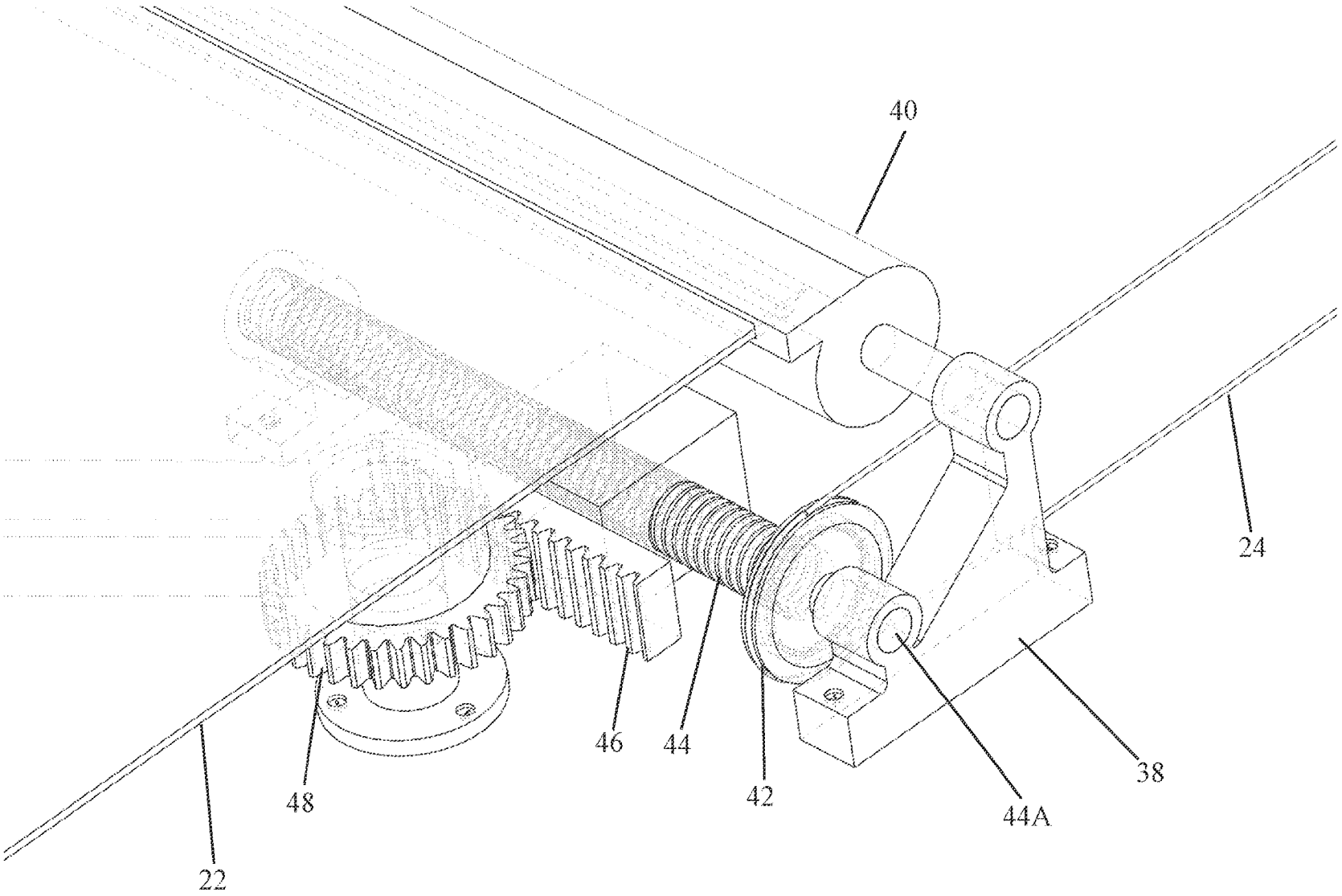
FIG. 8 illustrates a detailed perspective view of an awning arm movement assembly usable in the awning and retractable roof of FIG. 1.
Figure 9:
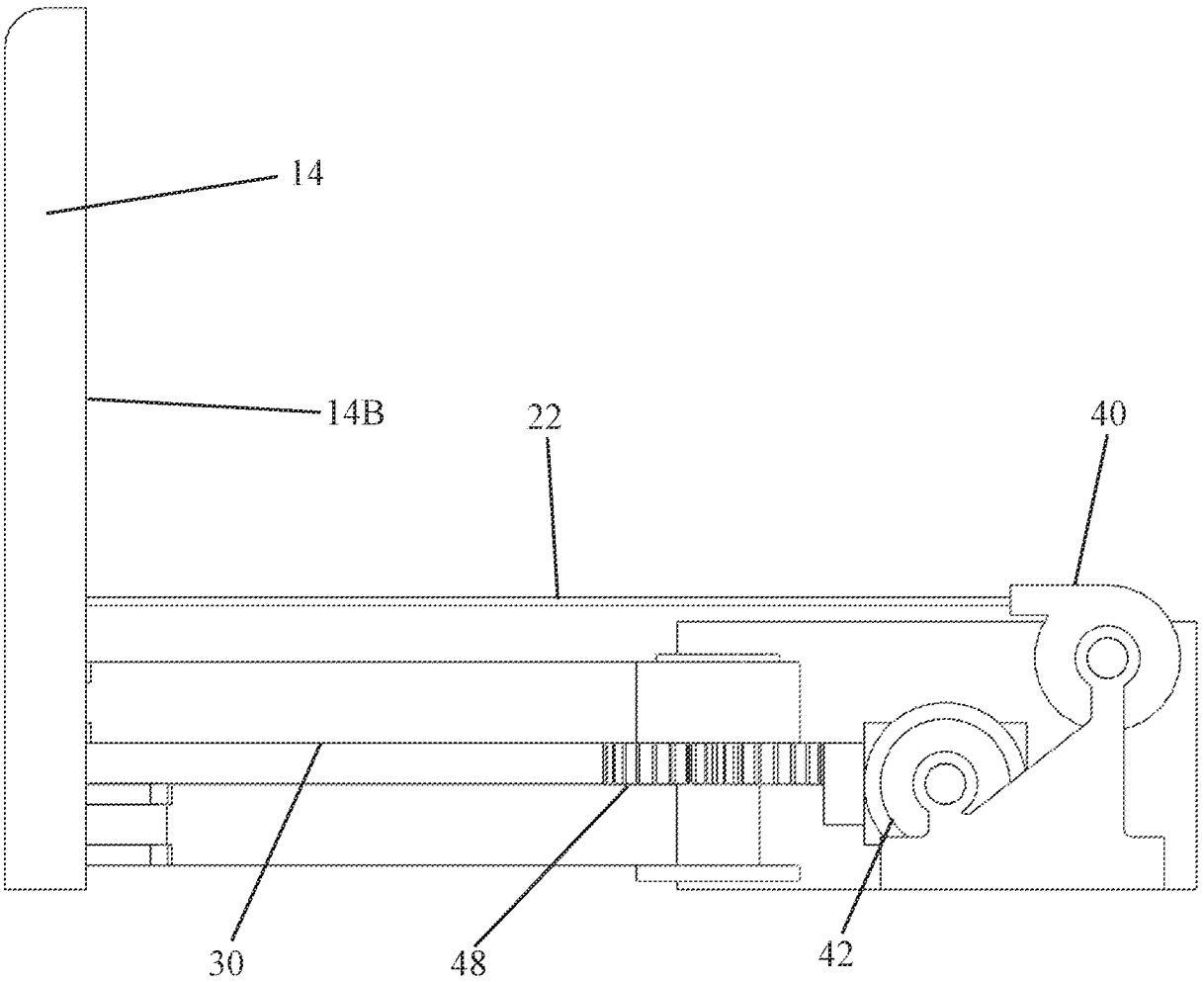
FIG. 9 illustrates a side view of the awning assembly in a partially extended state.

FIG. 7 shows a bottom view of the main drive mechanism. The pulley and the filament/screw rod are of one-piece structure, and no relative movement or rotation will occur therebetween. When the roller rotates, the screw rod produces the same rotation, which drives the rack slider in the direction of the arrow. The rack slider drives the gear and the push rod to rotate in the direction of the arrow. FIG. 8 is the schematic view of the main transmission mechanism. Gear housing can restrict the position of gear and push rod. FIG. 9 is the side view of the main transmission mechanism and folding mechanism.

Figure 10:
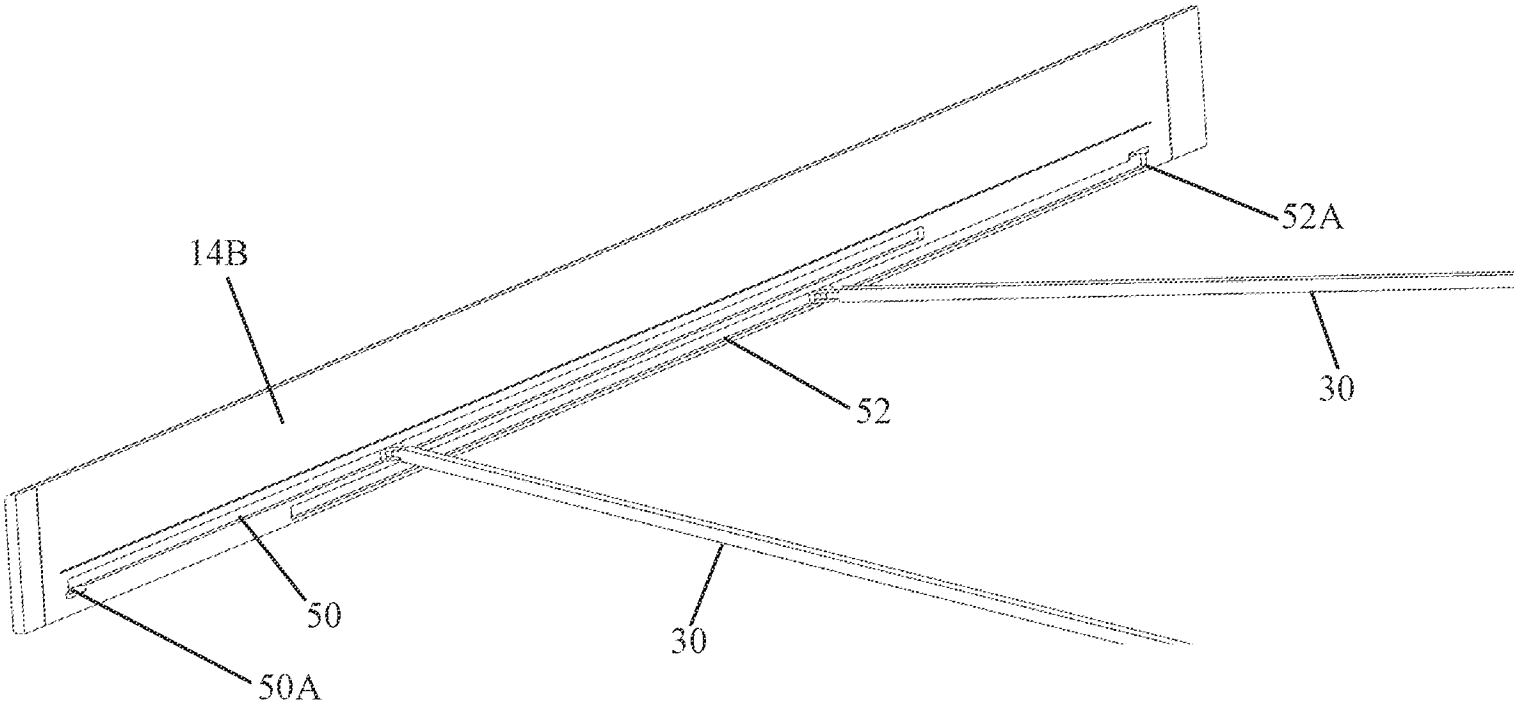
FIG. 10 illustrates a perspective view of a protection plate of the awning when in a partially extended state.

FIG. 10 shows a schematic view of the folding mechanism. The push rod pushes the protection plate forward during rotation. The rotatable slider can be hinged to the push rod and can slide in the slots on the inside of the protection plate.

FIG. 11 shows a schematic view and cross-section of the coiled spring roller. The roller face will wrap around the multi-layer drive belt and the hole fits into the rotating shaft. The coiled spring can be located inside the part.

FIG. 12 shows the schematic view of the internal control mechanism. A belt block is mounted at the end of the drive belt, and the module clasp enables the awning structure to be deployed simultaneously with the foldable roof by limiting the position of belt block. Moreover, if the belt block is removed from the block clasp, the awning structure will not unfold together with the foldable roof.

Referring to specifically now to FIGS. 1 through 5, an awning structure 10 can include, optionally, a retractable roof 12 (also referred to as collapsible roof 12, folding roof 12, or simply, roof 12) with a protection plate 14 disposed on an outside end 12A of the roof 12. First and second rollers 16 may be fixed on opposite ends of a roller shaft 18 so that rotation of the rollers 16 and roller shaft 18 occurs simultaneously. The roller shaft 18 may span an axis that is generally parallel to a longitudinal axis of the protection plate 14, where the protection plate is located on the outer end of the roof 12 and the roller shaft 18 is disposed along an inside end 12B of the roof 12, as can be seen in FIG. 1. In some embodiments, the rollers 16 and roller shaft 18 may be referred to as an internal control mechanism.

A main drive mechanism 20 can be disposed on the outside end 12A of the roof 12, where an awning fabric 22 may extend from the main drive mechanism 20 when the protection plate 14 is extended from the outside end 12A of the roof 12, as illustrated in FIG. 2.

A drive belt 24 can be wrapped about roller 16 and can extend therefrom. The drive belt 24 can extend to the main drive mechanism 20 to operate the extension of arms 30 that push out the protection plate 14 and, thus, extends the awning fabric 22, as described in greater detail below. As the roof is extended in the direction of arrow 14A, the drive belt 24 can unwind, in the direction of arrow 16A, from the roller 16. A distal end 24A of the drive belt 24, after wrapping around the main drive mechanism 20 and extending back toward the roller 16 may be fixed in a fixed location, to permit automatic deployment of the awning structure as the roof is extended, or may be movable, which can allow the roof to be extended without extending the awning. Details of this mechanism are described below.

Referring now also to FIGS. 6 through 10, the drive belt 24 can extend around a pulley 42 rotatably mounted on a housing 38. A screw rod 44 can be attached to and extend from a center of the pulley 42 so that rotation of the pulley 42 causes rotation of the screw rod 44. A rack 46 may extend along the screw rod 44 during rotation thereof, where the rack 46 causes rotation of a pinion 48 that has the arm 30 attached thereto. Thus, rotation of the pulley 42 along an axis 44A that is generally perpendicular to a direction of extension of the awning fabric 22 from an awning spool 40, causes the screw rod 44 to rotate along this axis 44A, which, in turn, causes the rack 46 to move in a direction generally parallel to the axis 44A. Movement of the rack 46 causes the pinion 48 to rotate about axis 48A, where axis 48A is generally orthogonal to the axis 44A. Such rotation of the pinion 48 causes the arms to move from a folded position (generally parallel to axis 44A) to an extended position, pushing out the protection plate 14, having the awning fabric 22 attached thereto, to extend the awning fabric 22 out of the awning spool 40 that is mounted on the housing 38.

As best seen in FIG. 10, the protection plate 14 may pivotably attach to each of the arms 30. Further, each of the arms 30 may move in a slot 50, 52 formed along the trailing side 14B of the protection plate 14. A first slot 50, supporting one of the arms can extend from one end 50A of the protection plate 14, along a majority of the length of the protection plate 14, and terminate prior to the other end of the protection plate 14. A second slot 52, supporting the other one of the arms 30, can extend from one end 52A of the protection plate 14, along a majority of the length of the protection plate 14, and terminate prior to the other end of the protection plate. The length of the slots 50, 52 may be approximately a length of the arms 30, as when the awning is retracted, the trailing side 14B of the protection plate 14 is adjacent the arms 30 in their folded configuration. When the awning is fully extended, the arms 30 may engage near ends 50A, 52A of the respective slots 50, 52. In some embodiments, the arms 30 may extend perpendicular to the axis of the awning spool 40 (or parallel to a direction of extension of the awning fabric 22.

As discussed above, one of the arms 30 and its respective gearing may be disposed offset from the other one of the arms 30. Thus, when the awning is retracted, the arms may be disposed in a vertically overlapping arrangement.

Figure 11B:
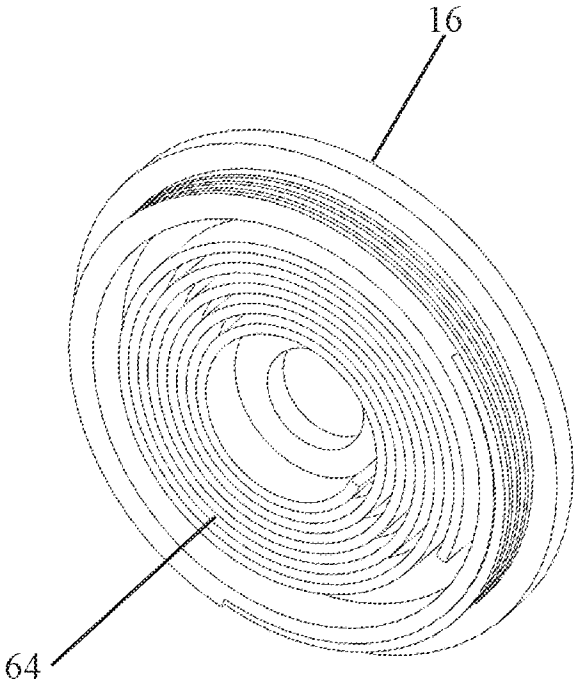
FIG. 11B illustrates a perspective view of a recoil spring mechanism used with the roller mechanism of FIG. 11A.
Figure 11A:
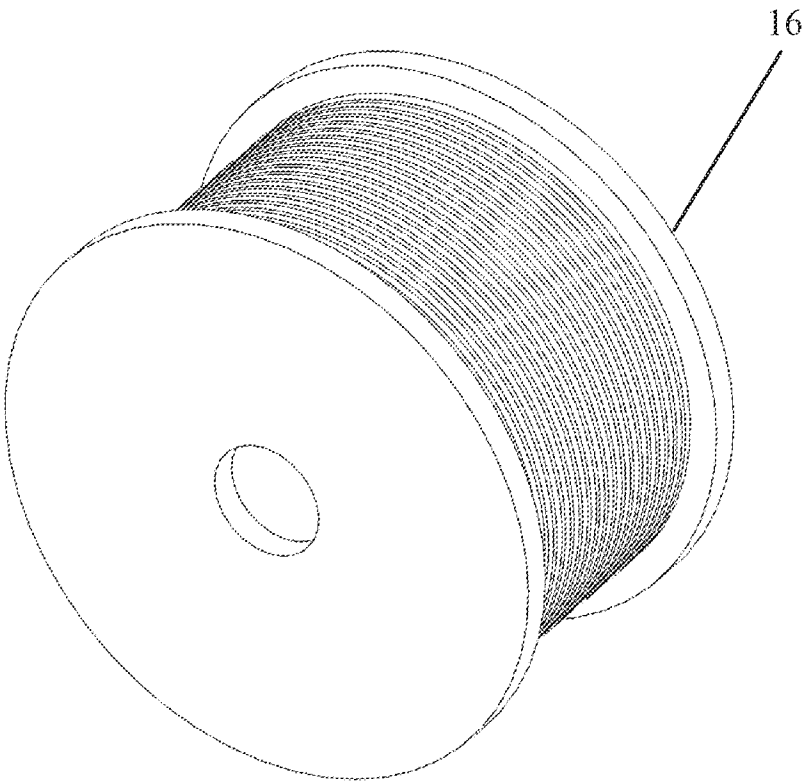
FIG. 11A illustrates a perspective view of a roller mechanism used with the awning of FIG. 1.

In some embodiments, the housing 38 may be fixed to a distal one 12C of the panels of the retractable roof 12. As the roof 12 is extended, the housing 38 is extended as well, away from the rollers 16. When the distal end 24A of the belt 24 is fixed, the extension of the roof 12 causes the belt 24 to move the pulley 42, automatically deploying the awning structure 10 during roof extension. A recoil spring 64 may be deployed in the roller 16, as shown in FIGS. 11A and 11B to urge the drive belt 24, wrapped around the roller 16, back to a retracted state. The recoil spring 64 may also provide tension in the belt 24, thus ensuring that the pulley 42 rotates as the belt 24 is extended from the roller 16.

As shown in FIG. 12, a belt end clasp 66 may be disposed adjacent the roller 16. It should be understood that the belt end clasp 66 may be disposed in other positions as well, provided that the belt end clasp 66 can removably secure the distal end 24A of the belt 24. A belt block 68 may be disposed at the distal end 24A of the belt 24 to permit the distal end 24A to be removably connected to the belt end clasp 66. When the belt block 68 is attached to the belt end clasp 66, the awning may be automatically deployed when the roof 12 is extended and the awning may be automatically stowed when the roof 12 is retracted. A user may remove the belt block 68 from the belt end clasp 66. In this embodiment, the belt 24 may not rotate the pulley 42 during extension and retraction of the roof 12, permitting the user to manually extend or retract the awning as desired. Such a feature may be useful where the awning is deployed in a windy environment, where the awning may be set up to automatically deploy, but the user may be able to stow the awning and later extend the awning without the requirement to retract or expand the roof. In this embodiment, there may be provided a connection (not shown) to permit the user to manually turn the pulley 42 or the pinion 48 or a motor may be provided to automatically make these motions.

While the belt block 68/belt end clasp 66 structure is provided to engage/disengage the belt 24 from the pulley 42, other arrangements may be provided, such as an idler pulley, a gearing mechanism in the roller 16, or the like.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An awning system comprising:

a housing fixed to a structure;

an awning spool supported by the housing and having awning fabric extendable therefrom and retractable thereinto;

a first arm supported by the housing and disposable alongside the structure supporting the awning spool;

a second arm supported by the housing and disposable adjacent the first arm and alongside the structure;

first and second gearing structures each supported by the housing and configured to pivot, respectively, the first arm and the second arm, at a first end of each thereof, simultaneously away from the structure;

a protection plate pivotably connected to a second end of each of the first and second arms, the protection plate attached to a distal end of the awning fabric to move the awning fabric off the awning spool and above the first and second arms, as the first and second arms move the protection plate away from the structure;

first and second pulleys associated with each of the first and second gearing structures, each pulley rotatably attached to the housing; and first and second rollers each having a belt wrapped therearound and each belt extending around respective first and second pulleys and further extending back toward the respective first and second rollers, wherein:

the first and second rollers being in a fixed location during retraction and extension of the structure; and the structure is an outside end of a retractable roof, wherein the housing moves during retraction and extension of the retractable roof.

2. The awning system of claim 1, wherein:

a distal end of each belt is fixed adjacent each respective first and second rollers; and movement of the outside end of the retractable roof during retraction and extension of the retractable roof turns the first and second pulleys to extend respective first and second arms to push the protection plate away from the structure.

3. The awning system of claim 2, wherein the first and second gearing structures include:

first and second screw rods each turning with rotation of respective first and second pulleys;

first and second racks movable along respective first and second screw rods during turning of respective first and second screw rods; and first and second pinions movable with respective first and second racks with rotation of respective first and second pulleys, wherein the first end of the first arm is connected to the first pinion and the first end of the second arm is connected to the second pinion.

4. The awning system of claim 1, wherein:

a distal end of each the belt is movable during retraction and extension of the retractable roof; and movement of the outside end of the retractable roof during retraction and extension of the retractable roof is performed without turning the first and second pulleys and respective first and second arms and the protection plate are retained in a stowed configuration during movement of the outside end of the retractable roof.

5. The awning system of claim 1, wherein:

a distal end of each belt is movable between a fixed position adjacent each respective first and second rollers and an unfixed position where the distal end of each belt is movable during retraction and extension of the retractable roof.

6. The awning system of claim 1, wherein the second end of each of the first and second arms are disposed in respective first and second slots formed longitudinally along a trailing side of the protection plate.

7. The awning system of claim 6, wherein:

the first slot extends from a first side edge of the trailing side of the protection plate, across a majority of a length of the protection plate, to terminate before reaching a second side edge of the trailing side of the protection plate;

the second slot extends from the second side edge of the trailing side of the protection plate, across a majority of a length of the protection plate, to terminate before reaching the first side edge of the trailing side of the protection plate; and the first slot being vertically offset and parallel to the second slot.

8. The awning system of claim 1, wherein each of the first and second rollers include a recoil spring operable to resiliently urge the respective belt to wrap around respective first and second rollers.

9. An awning system comprising:

a housing fixed to a structure;

an awning spool supported by the housing and having awning fabric extendable therefrom and retractable thereinto;

a first arm supported by the housing and disposable alongside the structure supporting the awning spool when the awning fabric is retracted;

a second arm supported by the housing and disposable adjacent the first arm and alongside the structure when the awning fabric is retracted;

first and second pulleys, each pulley rotatably attached to the housing;

first and second rollers each having a belt wrapped therearound and each belt extending around respective first and second pulleys and further extending back toward the respective first and second rollers, the first and second rollers being in a fixed location during retraction and extension of the retractable roof;

first and second screw rods each turning with rotation of respective first and second pulleys;

first and second racks movable along respective first and second screw rods during turning of respective first and second screw rods; and first and second pinions movable with respective first and second racks with rotation of respective first and second pulleys, wherein the first end of the first arm is connected to the first pinion and the first end of the second arm is connected to the second pinion; and a protection plate pivotably connected to a second end of each of the first and second arms, the protection plate attached to a distal end of the awning fabric to move the awning fabric off the awning spool and above the first and second arms, as the first and second arms pivot to move the protection plate away from the structure.

10. The awning system of claim 9, wherein the structure is an outside end of a retractable roof, wherein the housing moves during retraction and extension of the retractable roof.

11. The awning system of claim 10, wherein:

a distal end of each belt is movable between a fixed position adjacent each respective first and second rollers and an unfixed position where the distal end of each belt is movable during retraction and extension of the retractable roof.

12. The awning system of claim 11, wherein:

the distal end of each belt is fixed adjacent each respective first and second rollers; and movement of the outside end of the retractable roof during retraction and extension of the retractable roof turns the first and second pulleys to extend respective first and second arms to push the protection plate away from the structure.

13. The awning system of claim 11, wherein:

the distal end of each belt is movable during retraction and extension of the retractable roof; and movement of the outside end of the retractable roof during retraction and extension of the retractable roof is performed without turning the first and second pulleys and respective first and second arms and the protection plate are retained in a stowed configuration during movement of the outside end of the retractable roof.

14. The awning system of claim 9, wherein the second end of each of the first and second arms are disposed in respective first and second slots formed longitudinally along a trailing side of the protection plate.

15. The awning system of claim 14, wherein:

the first slot extends from a first side edge of the trailing side of the protection plate, across a majority of a length of the protection plate, to terminate before reaching a second side edge of the trailing side of the protection plate;

the second slot extends from the second side edge of the trailing side of the protection plate, across a majority of the length of the protection plate, to terminate before reaching the first side edge of the trailing side of the protection plate; and the first slot being vertically offset and parallel to the second slot.

16. An awning system comprising:

a retractable roof;

a housing fixed to an outside end of the retractable roof, the outside end moving during retraction and extension of the retractable roof;

an awning spool supported by the housing and having awning fabric extendable therefrom and retractable thereinto;

a first arm supported by the housing and disposable alongside the structure supporting the awning spool;

a second arm supported by the housing and disposable adjacent the first arm and alongside the structure;

first and second gearing structures each supported by the housing and configured to pivot, respectively, the first arm and the second arm, at a first end of each thereof, simultaneously away from the structure;

a protection plate pivotably connected to a second end of each of the first and second arms, the protection plate attached to a distal end of the awning fabric to move the awning fabric off the awning spool and above the first and second arms, as the first and second arms move the protection plate away from the structure;

first and second rollers attached to an inside end of the retractable roof, the inside end fixed during retraction and extension of the retractable roof; and first and second belts wrapped around and extending from respective first and second gearing structures, wherein movement of the retractable roof causes the first and second belts to move and engage with the first and second gearing structures.

17. The awning system of claim 16, wherein:

a distal end of the first and second belts is movable between a fixed position adjacent each respective first and second rollers and an unfixed position where the distal end of each belt is movable during retraction and extension of the retractable roof;

when the distal end of each belt is fixed adjacent each respective first and second rollers, movement of the outside end of the retractable roof during retraction and extension of the retractable roof turns the first and second gearing structures to extend respective first and second arms to push the protection plate away from the structure; and when the distal end of each belt is movable during retraction and extension of the retractable roof, movement of the outside end of the retractable roof during retraction and extension of the retractable roof is performed without turning the first and gearing structures and respective first and second arms and the protection plate are retained in a stowed configuration during movement of the outside end of the retractable roof.

18. The awning system of claim 16, wherein the first and second gearing structures include:

first and second pulleys rotatably supported by the housing;

first and second screw rods each turning with rotation of respective first and second pulleys;

first and second racks movable along respective first and second screw rods during turning of respective first and second screw rods; and first and second pinions movable with respective first and second racks with rotation of respective first and second pulleys, wherein the first end of the first arm is connected to the first pinion and the first end of the second arm is connected to the second pinion.

* * * * *